US005918402A

United States Patent [19]

Weinraub

[11] Patent Number: 5,918,402

[45] Date of Patent: Jul. 6, 1999

[54] GUN TRIGGER BLOCKING APPARATUS

[75] Inventor: Adam S. Weinraub, Orange, Calif.

[73] Assignee: Weinraub Enterprises, Inc., Orange, Calif.

[21] Appl. No.: 08/951,136

[22] Filed: Oct. 15, 1997

[51] Int. Cl.[6] ..... F41A 17/00

[52] U.S. Cl. ..... 42/70.07; 42/70.11

[58] Field of Search ..... 42/70.07

[56] References Cited

U.S. PATENT DOCUMENTS

| | | | |
|---|---|---|---|
| 3,392,471 | 7/1968 | Foote | 42/70.07 |
| 3,422,560 | 1/1969 | Foote et al. | 42/70.07 |
| 5,437,119 | 8/1995 | Womack . | |
| 5,487,234 | 1/1996 | Dragon | 42/70.07 |

*Primary Examiner*—Charles T. Jordan
*Assistant Examiner*—Denise J Buckley
*Attorney, Agent, or Firm*—Harold L. Jackson

[57] ABSTRACT

A gun trigger blocking apparatus to deter children and unauthorized and uninformed adults from being able to work the trigger and shoot a gun, rifle or shotgun. A first body member, adapted to be mounted on one side of a trigger guard, has an opening therein with buttress thread engaging grooves for receiving and releasable holding a locking rod affixed to a second body member adapted to be mounted on the other side of the trigger guard. A key lock is mounted on the first body member and arranged to rotate to an open mode by a key. Once in the open mode, the lock must then be depressed inwardly and at the same time a spring biased safety pin must be forced inwardly to disengage the buttress thread engaging grooves from the locking rod to allow the body members to be removed from the trigger guard. In addition, a second spring biased pin is provided which, when depressed inwardly, prevents the key lock from being depressed inwardly to deter and confuse a child or thief into thinking that it too must be actuated to release the connected body members.

13 Claims, 3 Drawing Sheets

GUN TRIGGER BLOCKING APPARATUS

BACKGROUND OF THE INVENTION

1. Field of the Invention

The present invention relates generally to a firearm safety lock device and more particularly to a new gun trigger blocking apparatus defined by a first locking body member and a second locking body member whereby the two locking body members are adapted to be unlocked and separated from each other by activating a key lock cylinder and a spring biased safety pin.

2. Description of the Related Art

Since children are attracted to guns, and many have a great curiosity about them, there is a need for an improved safety lock device for guns. While adults may believe that guns are safely put away, children many times will find a way to get to them and handle them. As is well known, guns are not only used to hunt game and in sports shooting events, but are increasingly relied on for self defense. A gun is not a plaything and should be used carefully and stored in a responsible manner.

The fatalities and injuries resulting from the accidental discharge of firearms, particularly by children, has become such a problem in the United States that Congress and many state legislative bodies, are considering legislation requiring that each new purchaser of a gun be accompanied by the purchase of a suitable lock.

Many gun owners store guns in their homes because they want to have them readily available in case of a burglary, etc. Therefore, each gun stored within a house or dwelling should be provided with a simple but positive locking device that denies an unauthorized person, such as a child, from being able to use a gun, yet allows the owner reasonably quick access.

Locking devices which clamp around the trigger guard of a gun for preventing access to the trigger have been used in the past. However, such locking devices generally employ simple locking means that can be opened only with a key being placed in the key cylinder and rotating the key to unlock the device. Often the key is not close at hand or it is hidden and not readily available to be used in an emergency situation, but if the key is available so is easy access and use of the gun.

U.S. Pat. No. 5,437,119, to Robert Womack and assigned to the assignee of the subject invention, discloses a gun trigger blocking structure in which a pseudo lock and a blocking pin must be simultaneously depressed to disable the blocking structure. The Womack gun lock renders a gun substantially unaccessible to children, particularly of a young age, while allowing an owner to quickly disable the lock without a key. However, there is a need for a gun trigger blocking structure which renders a gun more permanently unaccessible to persons (including children) other than the owner by means of an operative key lock while at the same time making it difficult for such persons (other than the owners) to obtain access to the trigger even after the key lock has been disabled with a key.

SUMMARY OF THE INVENTION

Therefore it is an important object of the present invention to provide a gun trigger blocking apparatus defined by first and second body members or blocking halves that prevent use of the gun in that the trigger is prevented from being moved while enclosed in the structure of the trigger blocking apparatus.

Another object of the invention is to provide a suitable gun trigger blocking apparatus, wherein the first body member includes a key operated lock cylinder that is used in combination with a spring biased safety pin to allow removal of the apparatus and provide access to the trigger. In accordance with the present invention, the lock cylinder must be rotated to an open mode, depressed inwardly and at the same time the spring biased safety pin must be forced inwardly so as to disengage the key cylinder to allow it to be pressed inwardly, thus releasing a locking member or rod mounted in the second body member and allowing the two body members to be separated and thereby releasing the trigger and gun.

Another object of the present invention is to provide a gun trigger blocking apparatus wherein the first body member includes a second spring biased pin that when pressed inwardly prevents the key cylinder from moving inwardly so as to deter and confuse a child or a thief into thinking that it too must be employed to release the connected body members.

Still another object of the present invention is to provide a plurality of pin receiving openings in the inner face of one of the body members to allow the placement of trigger blocking pins within the structure. A further object of the invention is to provide a gun lock apparatus of this character having few moving parts and is simple to operate and rugged in construction.

The construction and operation of the gun trigger blocking apparatus of the present invention may be best understood by reference to the following description taken in conjunction with the accompanying drawings in which like components are given the same reference numeral.

DESCRIPTION OF THE PREFERRED EMBODIMENT

Figure 1:
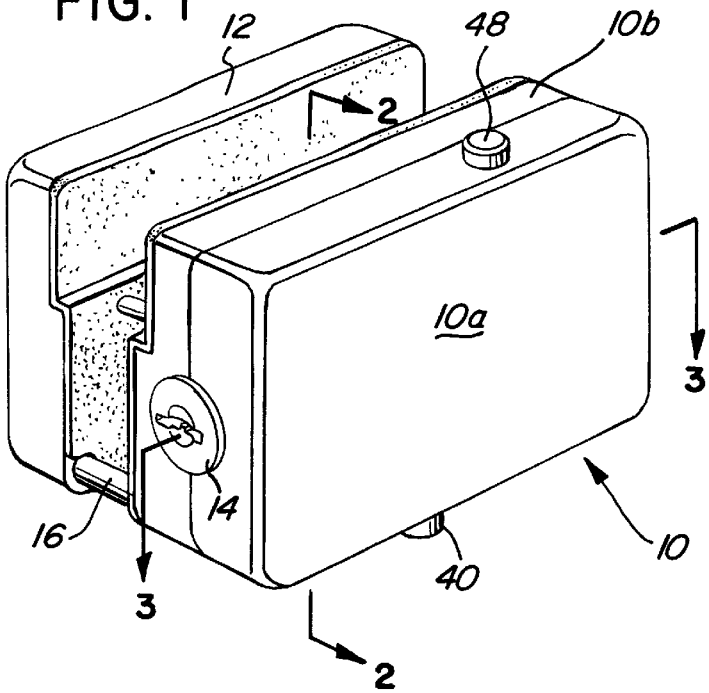
FIG. 1 is a perspective view of the assembled gun trigger blocking apparatus in accordance with the present invention.

Referring now to the drawings and particularly to FIG. 1, the first and second body members or blocking halves 10 and 12, respectively, of the gun trigger blocking structure, are shown in an assembled condition. The first body member is formed of an outer section 10*a* and an inner section 10*b* for ease of assembly. A conventional key lock cylinder or tumbler 14 is carried by the first body member 10. A theft prevention pin 16 is mounted in the body member 12 and received in a bore 17 (FIG. 7) in inner section 10*b* of the first blocking member for receiving one end of a chain to be secured to an relatively immoveable object.

Referring now to the additional figures, a locking member, in the form of a bar or rod 18, is threadably secured into a threaded blind bore 20 in the second body member 12 and extends through a central opening 22 in the first body member 10. See FIGS. 3 and 5. The distal end of the rod 18 is provided with buttress threads or grooves 18*a*. See FIG. 3 in particular. A latching member, in the form of a plate 24, is slidably contained (along the longitudinal axis x—x of the lock cylinder) within a rectangular opening 26 between the adjacent faces of the inner and outer body sections 10*a* and 10*b*. The latching plate 24 has an opening 28 through which the buttress threaded portion of the locking rod 18 extends when the body members are in an assembled condition. Buttress thread engaging grooves 28*a* (or threads) are provided on the back side of opening 28 for engaging and capturing the buttress threads 18*a* on locking rod 18 when the latching plate 24 is in the position shown in FIG. 2, as will be more fully explained. The front side 28*b* of the opening 28 has a smooth wall and extends around the outer circumference of the buttress threaded end of the locking rod so that the rod can be readily removed from the first body member or blocking half 10 when the latching pate is in the position shown in FIG. 2A.

A stub rod 24*a* extends rearwardly from the latching plate and into a guide hole 30 therefore. A coil spring 32 is resiliently compressed on stub rod 24*a* between the rear end of the plate and an internal shoulder 34 at the start of the guide hole 30. Thus, the latching plate with the buttress thread engaging grooves 28*a* is resiliently biased along the longitudinal axis of the cylinder lock toward an outer position by the spring 32 to secure the locking member within the first body member 10.

The key lock cylinder 14 is mounted within a cylindrical stepped bore 36 which abuts the rectangular opening 26 housing the latching plate. The lock cylinder may be turned, within the opening 36, from its locked position (first angular position) through an angle of 90° to its unlocked position (second angular position) by means of key 37. The 90° angle is set by an L-shaped slot 14*a* in the cylinder which receives the free end of an indexing pin 38. The pin 38 is inserted through a hole 39 in the inner section 10*b* of the first body member during assembly of the structure. The indexing pin and slot 14*a* also limit the inward movement of the cylinder lock 14 from its outer position shown in FIG. 2 (first axial position)to its inner position shown in FIG. 2A (second axial position) to allow the blocking members to be separated, as will be explained more fully.

Figure 2:
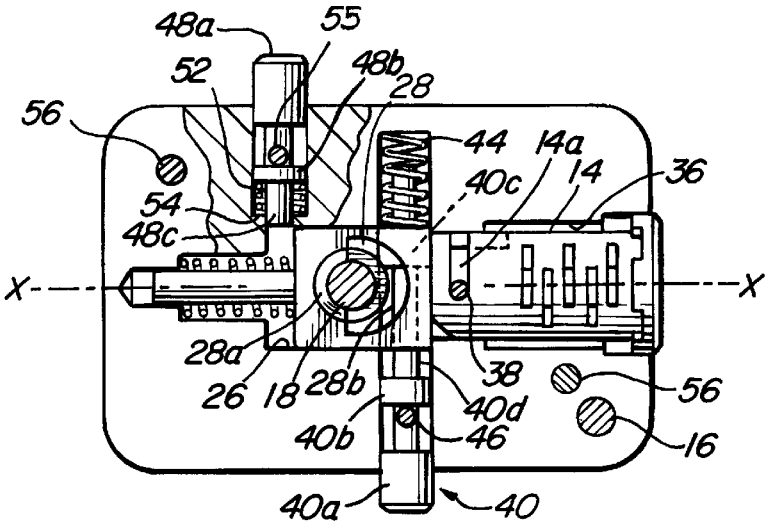
FIG. 2 is an elevational view of the inner face of the first body member or block half, partially in section, looking along lines 2—2 of FIG. 1 showing the latching plate carried by the first body member in engagement with a locking member carried by the second body member.
Figure 6:
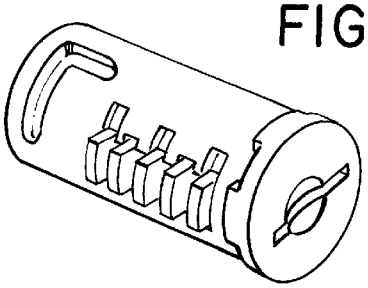
FIG. 6 is a perspective view of a conventional key cylinder lock mounted in the first body member.
Figure 2A:
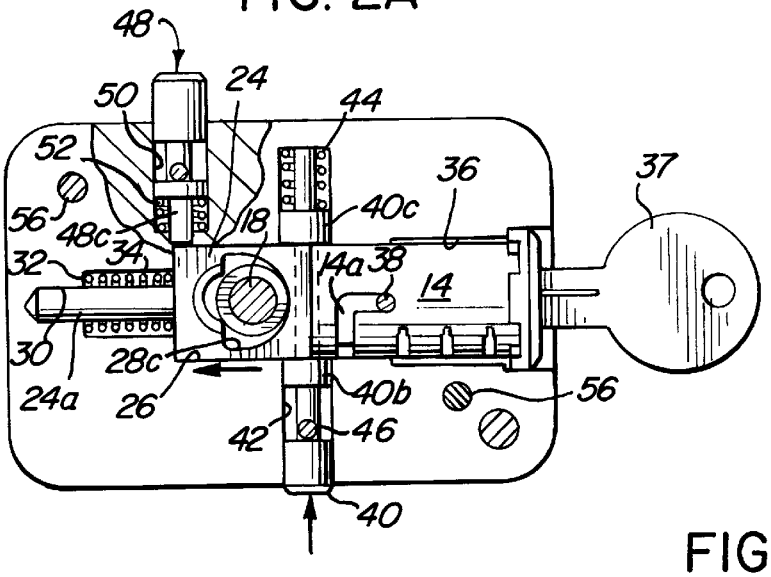
FIG. 2A is the same view as FIG. 2 showing the latching plate disengaged from the locking member.

A first blocking pin 40, inserted in a blind bore 42 in the outer section 10*a* of the first body member, is resiliently biased toward an outer position by a coil spring 44 compressed between the bottom of the bore 42 and an annular shoulder on pin 40 as is illustrated in FIG. 2*a*. In its outer position, the proximal end 40*a* of the pin 40 extends to the exterior of the body member 10*a* as is illustrated in FIG. 2. The blocking pin proximal end 40*a*, an intervening annular ring 40*b* and an annular shoulder 40*c* are all substantially the same diameter providing a sliding fit within the bore 42. A small diameter portion 40*d* of pin 40 extends between the annular ring 40*b* and the annular shoulder 40*c*.

The blocking pin 40 is slidable between an outer lock cylinder blocking position (FIG. 2) and an inner unblocking position (FIG. 2A) as will be explained in more detail. A travel limit pin 46, carried by the first body member, projects into the space between the inner shoulder of the end 40*a* and the annular ring 40*b* of the blocking pin 40. This pin limits the range of movement of the blocking pin between its outer blocking and inner unblocking positions as is illustrated in FIGS. 2 and 2A.

Figure 5:
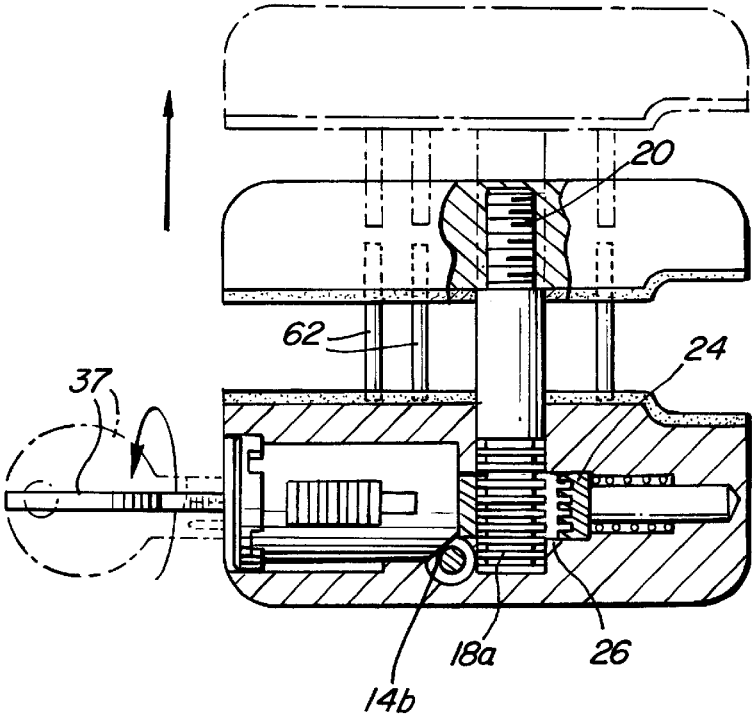
FIG. 5 is a view of the gun trigger blocking apparatus, similar to FIG. 3, with the key turning the cylinder back to disengage the latching plate from the locking member, and showing in phantom lines, the separation of the body members to provide access to the gun trigger.

The inner end of the lock cylinder, adjacent the blocking pin 40, has an angular relief surface 14*b* which allows the lock cylinder to move inwardly (along the longitudinal axis) from a first axial position to a second axial or inward position when rotated through 90° by the key 37 and when the blocking pin is simultaneously pushed in as is illustrated in FIGS. 2A and 5. When the blocking pin is left in its biased (outward) position (FIG. 2), the annular shoulder 40*c* thereof blocks the inward movement of the cylinder lock even when the lock is rotated to its second angular position by means of key 37.

A second blocking pin 48 with a outwardly projecting proximal end 48*a* is slidably mounted within another opening 50 within the outer section 10*a* of the first body member. The pin 48 is also resiliently biased outwardly by means of a coil spring 52 compressed between an inwardly projecting shoulder 54 in the opening 50 and a annular ring 48*b* of the pin 48. When the pin 48 is pushed inwardly, the distal end 48*c* thereof projects into the opening 26 to prevent the inward movement of the latching plate and the lock cylinder. A travel limit pin 55, carried by the inner section 10*b* of the first body member, projects into the space between the ring 48*b* and an inner shoulder of the proximal end of the pin 48. This pin limits the movement of the blocking pin 48 between its outer unblocking position (FIG. 2) and an inner blocking position in which the distal end 48*c* projects into the opening 26 when the latching plate is in its blocked position (FIG. 2A).

Figure 7:
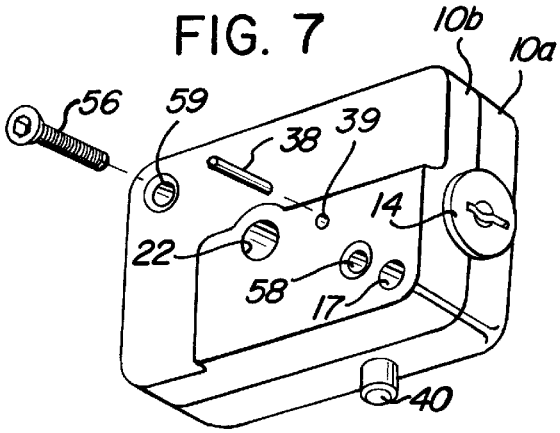
FIG. 7 is a perspective view of the first body member showing one of the bolts for securing the two sections of the member together along with a limit pin for limiting the rotational and inward movement of the cylinder lock.
Figure 8:
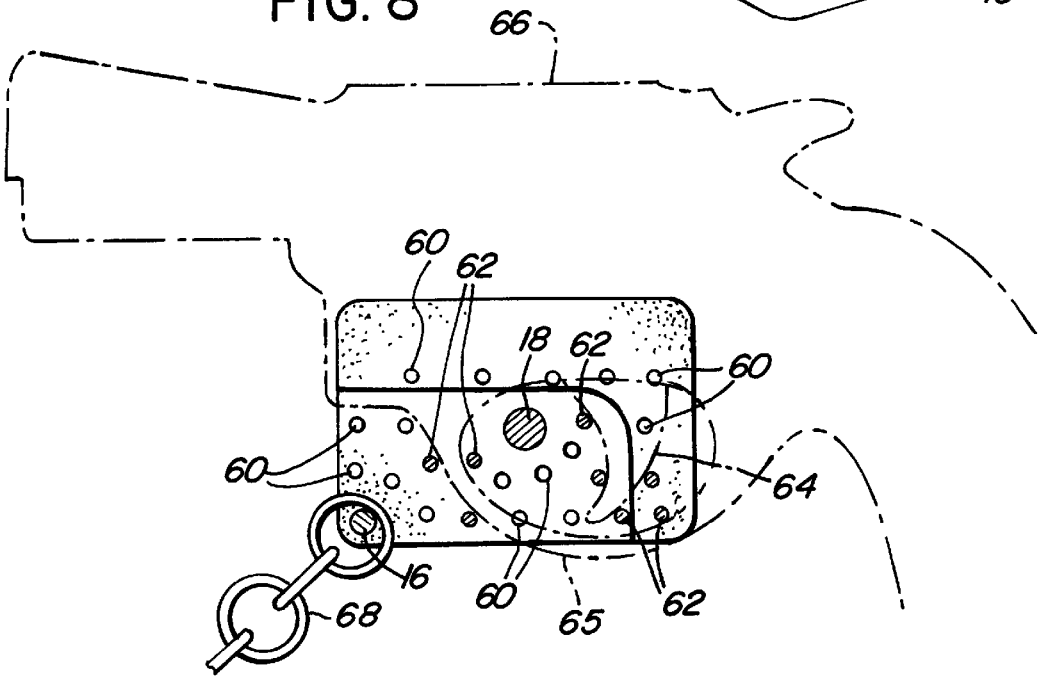
FIG. 8 is a diagrammatic view of the gun trigger blocking apparatus secured around the trigger of a revolver with several trigger movement blocking pins inserted in appropriate holes in the second body member and a theft prevention chain connected to a pin mounted on the first body member.
Figure 3:
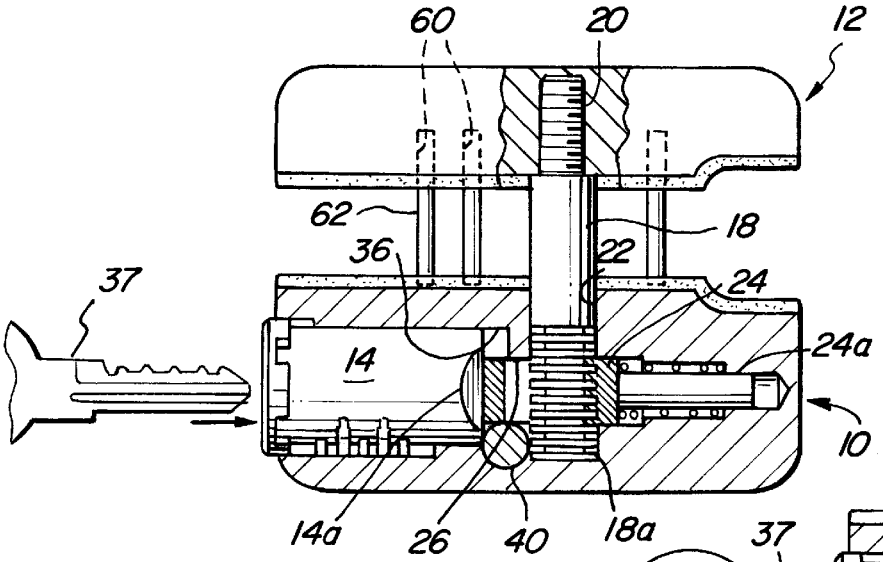
FIG. 3 is a view of both body members or block halves, partially in section, taken along lines 3—3 of FIG. 1.
Figure 4:
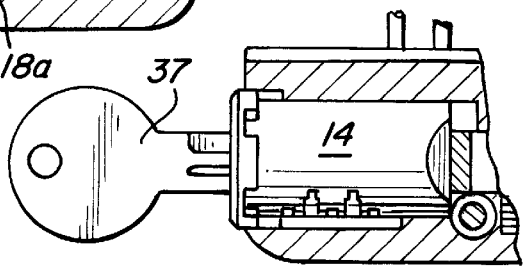
FIG. 4 is a view, partially in section, of a portion of the first body member with the key inserted in the cylinder lock, but not turned to rotate the lock.

Referring now to FIGS. 7 and 8, a pair of bolts 56 (only one of which is shown in FIG. 7) inserted through holes 59 and threaded into the tapped holes in the outer section 10*a* secure the inner and outer sections of the first body member together. The second body member 12 includes a plurality of tapped holes 60 for receiving one or more trigger guard pins 62. Several guard pins 62 are selectively positioned within the various holes 60, as is shown in FIG. 8, about the trigger 64 and trigger finger guard 65 of a gun 66 and extend between the body members 10 and 12 in their locked condition to prevent movement of the trigger as is illustrated in FIG. 8. A security chain 68 may be looped over the theft prevention pin 16 prior to the placement of the locking structure on the gun. The inner faces of the body members have stepped inner faces as is shown in FIGS. 1, 3 and 5 to accommodate the normally wider portion of a gun frame above the trigger guard. The inner faces of the two body members or blocking halves may also be provided with a compressible pad to protect the gun finish.

Once the gun trigger blocking apparatus has been placed over the trigger mechanism of a gun with the locking rod 18 secured within the latching plate 24 and the lock 14 enabled by the key 37, the mechanism can only be removed by several actions. First, the lock must be disabled by turning the cylinder lock 16, via key 37, from its first locked position to its second unlocked position, i.e., through the 90° angle. Second, the first blocking pin 40 must be pushed inwardly and then the cylinder lock must be depressed inwardly to disengage the latching plate from the buttress threaded end of the locking rod. The second blocking pin 48 acts as a deterrent to the unlocking operation since depressing it downwardly will prevent the cylinder lock from being depressed inwardly regardless of the position of the first blocking pin 40.

The invention has been described with respect to a preferred embodiment. However, various modifications and improvements therein will become apparent to those skilled in the art without involving any departure from the spirit and scope of the invention as defined in the appended claims.

What is claimed is:

1. A gun trigger blocking apparatus comprising:

a) first and second blocking halves adapted to be mounted on opposite sides of a gun trigger guard;

b) a locking member mounted on one of the block halves and arranged to extend into an opening in the other block half;

c) locking member engaging means including a key lock mounted in the other block half, the key lock being rotatable by a key between first and second angular positions and being moveable within said other block half between first and second axial positions when rotated to the second angular position, the locking member engaging means being arranged to engage the locking member and prevent separation of the blocking halves when the key lock is in the first axial position and to disengage the locking member and allow the blocking halves to be separated when the key lock is in the second axial position;

d) at least one trigger blocking member extending from at least one of the block halves for blocking movement of a trigger of a gun on which the trigger blocking apparatus is mounted;

e) a spring for biasing the key lock to its first axial position:

f) a first key lock blocking member mounted in the other block half for selectively preventing the key lock from moving from the first to the second axial position, the first key lock blocking member being in the form of a first pin moveable between nonengaging and engaging key lock positions to allow the key lock to move to the second axial position when in the nonengaging position and to prevent the key lock from moving to the second axial position when in the engaging position; and g) a spring for biasing the first pin to its engaging position.

2. The invention of claim 1 further including a second key lock blocking member mounted in the other block half for selectively preventing the key lock from moving from the first to the second axial position.

3. The invention of claim 2 wherein the second key lock blocking member is in the form of a second pin moveable between nonengaging and engaging key lock tumble positions to allow the key lock to move to the second axial position when in the nonengaging position and to prevent the key lock from moving to the second axial position when in the engaging position.

4. The invention of claim 3 further including a spring for biasing the second pin to the nonengaging position.

5. The invention of claim 4 wherein the locking member engaging means further includes a latching plate which is axially moveable with the key lock and engages the locking member to prevent separation of the block halves when the key lock is in the first axial position.

6. The invention of claim 5 wherein the latching member is in the form of a locking shaft having a threaded free end and wherein the latching plate defines an opening therethrough for receiving the free end of the locking shaft, the latching plate having a buttress threaded portion on one side of the opening which engages the threads on the locking shaft when the key lock is in the first axial position.

7. The invention of claim 6 wherein the blocking halves define inner faces which are adjacent each other when the blocking halves are assembled on the trigger guard and wherein one of the blocking halves carries a plurality of trigger blocking pins which extend inwardly toward the inner face of the other blocking half to prevent movement of the gun trigger when the blocking halves are in an assembled condition.

8. A gun trigger blocking apparatus comprising:

first and second body members adapted to be mounted on opposite sides of a gun trigger guard;

a locking bar carried by the second body member and arranged to extend into an opening in the first body member;

a latching plate slidably mounted in the first body member for selectively engaging the locking bar to prevent the removal thereof from the first body member;

a key lock cylinder carried by the first body member, the cylinder being rotatable in response to a key between first and second angular positions and slidable between first and second axial positions within the first body member, the lock cylinder being arranged to disengage the latching plate from the locking bar when moved to its second axial position;

at least one trigger blocking pin extending from one of the body members to block movement of the trigger of a gun on which the body members are mounted;

a spring for biasing the latching plate to its locking bar engaging position:

a first manually operable blocking pin for selectively preventing the cylinder lock from moving to the second axial position;

a spring for biasing the first blocking pin into a position to prevent the cylinder lock from moving to the second axial position; and a second manually operable blocking pin for selectively preventing the cylinder lock from moving to the second axial position.

9. The invention of claim 8 further including a spring for biasing the second blocking pin into a position to allow the cylinder lock to move to the second axial position.

10. The invention of claim 8 further including a pair of blocking pins slidably mounted between outer and inner positions in the first body member for controlling the axial movement of the cylinder lock, the pins being arranged so that the cylinder lock may be moved to its second axial position when one, but not both, of the blocking pins are moved to their inward positions.

11. A gun trigger blocking apparatus comprising:

first and second body members adapted to be mounted on opposite sides of a gun trigger guard;

a locking bar carried by the second body member and arranged to extend into an opening in the first body member;

a latching plate slidably mounted in the first body member for selectively engaging the locking bar to prevent the removal thereof from the first body member;

a key lock cylinder carried by the first body member, the cylinder being rotatable in response to a key between first and second angular positions and slidable between first and second axial positions within the first body member, the lock cylinder being arranged to disengage the latching plate from the locking bar when moved to its second axial position;

at least one trigger blocking pin extending from one of the body members to block movement of the trigger of a gun on which the body members are mounted; and a pair of blocking pins slidably mounted between outer and inner positions in the first body member for controlling the axial movement of the cylinder lock, the pins being arranged so that the cylinder lock may be moved to its second axial position when one, but not both, of the blocking pins are moved to their inward positions.

12. The invention of claim 11 further including springs for biasing the blocking pins to their outward positions.

13. The invention of claim 12 wherein the gun includes a trigger guard and further including a plurality of tapered holes in the second body member for receiving a selected pattern of trigger blocking pins which extend between the body members when the body members are mounted to the trigger guard.

* * * * *